US005729078A

United States Patent [19]

Pragt

[11] Patent Number: 5,729,078

[45] Date of Patent: Mar. 17, 1998

[54] ELECTRIC LAMP WITH CONTAINMENT SLEEVE HAVING A HELICALLY COILED METAL WIRE

[75] Inventor: Henrikus J. H. Pragt, Eindhoven, Netherlands

[73] Assignee: U.S. Philips Corporation, New York, N.Y.

[21] Appl. No.: 855,759

[22] Filed: Mar. 14, 1996

Related U.S. Application Data

[63] Continuation of Ser. No. 994,572, Dec. 22, 1992, abandoned.

[30] Foreign Application Priority Data

Dec. 23, 1991 [EP] European Pat. Off. ..... 91203379

[51] Int. Cl.[6] ..... H01J 5/02

[52] U.S. Cl. ..... 313/25; 313/312; 313/573; 313/634; 362/186

[58] Field of Search ..... 313/25, 493, 570, 313/573, 634, 635, 312, 580; 362/186; 220/201 R

[56] References Cited

U.S. PATENT DOCUMENTS

| | | | |
|---|---|---|---|
| 4,678,960 | 7/1987 | Reiling | 313/25 |
| 4,721,876 | 1/1988 | White et al. | 313/25 |
| 4,942,330 | 7/1990 | Karlotski et al. | 313/25 |
| 4,950,938 | 8/1990 | Ramaiah | 313/25 |

FOREIGN PATENT DOCUMENTS 0361530 4/1990 European Pat. Off. .

*Primary Examiner*—Ashok Patel
*Attorney, Agent, or Firm*—Walter M. Egbert, III

[57] ABSTRACT

The electric discharge lamp has a discharge vessel (2), which is mounted in an outer bulb (1). A glass sleeve (10) is surrounding the discharge vessel. A coiled wire (11) is used as an envelope (11) to a glass sleeve. The wire is in an electrically floating manner fixed around the sleeve (10), e.g. by clamping fit. The construction of the lamp is simple an effective to protect the outer bulb (1) from being damaged by an explosion of the lamp vessel (2) and to prevent sodium, if present, to disappear from the discharge vessel as a result of photoemission.

10 Claims, 1 Drawing Sheet

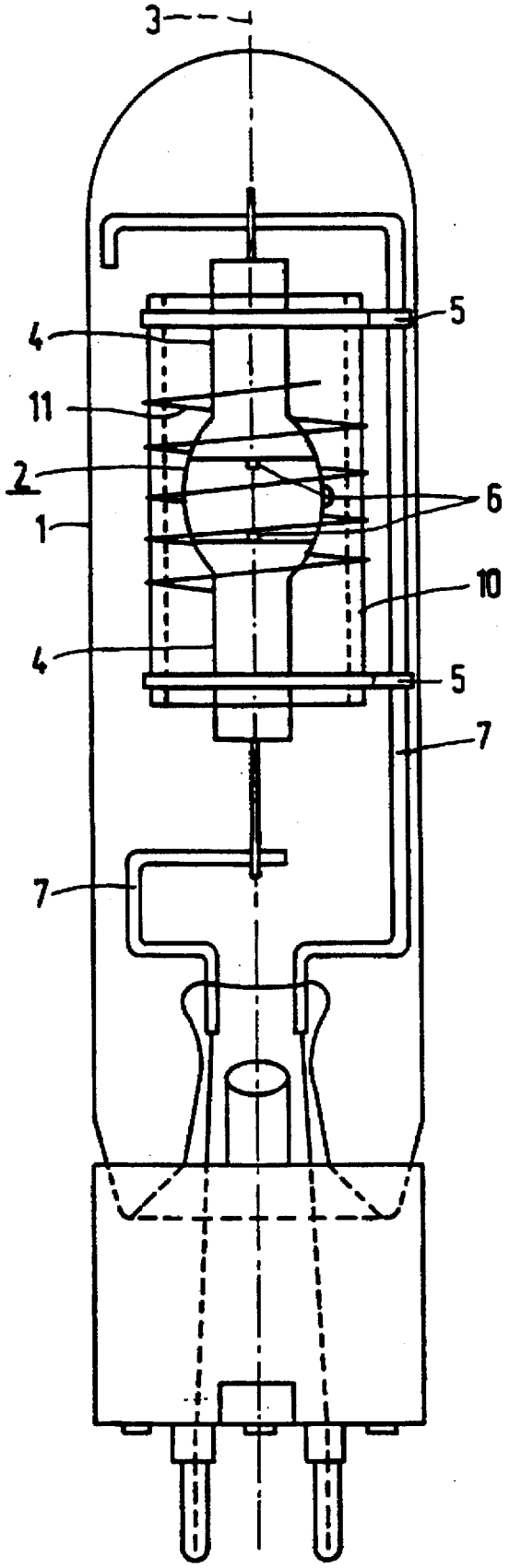
3
4
5
11
2
6
1
10
4
5
7
7

ELECTRIC LAMP WITH CONTAINMENT SLEEVE HAVING A HELICALLY COILED METAL WIRE

This is a continuation of application Ser. No. 07/994,572, filed on Dec. 22, 1992, now abandoned.

CROSS REFERENCE TO RELATED APPLICATION

This application relates to U.S. application Ser. No. 07/994,571 now U.S. Pat. No. 5,406,165, entitled "Electric Lamp" of Henrikus J. H. Pragt filed concurrently herewith which discloses and claims an HID lamp having a tubular shield fused to the exhaust tube of the discharge vessel.

BACKGROUND OF THE INVENTION

The invention relates to an electric discharge lamp comprising:

an outer bulb closed in a gastight manner;

a discharge vessel closed in a gastight manner and having an axis and seals on its axis, a pair of electrodes being arranged in said discharge vessel;

a glass tube axially surrounding the discharge vessel;

a light-transmitting metal part surrounding the tube; and current conductors which extend from outside the outer bulb to the pair of electrodes and are connected thereto.

Such an electric lamp is known from U.S. Pat. No. 4,721,876.

In the known lamp, the glass tube is surrounded by a meshwork of metal wire which is fixed around the tube with metal clamping strips. The clamping strips are electrically conducting and connected to a live mount which supports the discharge vessel and the tube. The meshwork as a result is under electrical tension, which can lead to the disappearance of sodium from the discharge vessel if the latter contains sodium. Changes in lamp characteristics are the result of this.

It is an object of the construction of the known lamp to keep the outer bulb intact if the discharge vessel should explode. Explosion may occur when the lamp reaches the end of its life.

The construction of the known lamp is complicated. The manufacture of the meshwork, or of a braided assembly, and its manipulation are difficult. Mother disadvantage is the risk of sodium disappearance.

SUMMARY OF THE INVENTION

It is an object of the invention to provide an electric lamp of the kind mentioned in the opening paragraph which is of a simple and reliable construction.

According to the invention, this object is achieved in that a helically coiled metal wire surrounds the glass tube and is fixed around this tube so as to be electrically floating.

The wire may be fastened to one of the current conductors by means of an electrically insulating bridge. An alternative possibility, however, is that the wire is fastened to the tube, for example, in that ends of the wire are fastened to the tube with cement or are fused into the tube.

A very attractive, convenient and reliable fastening is one in which the wire is fixed around the tube by its own clamping force. The wire has in that case been coiled on a mandrel with a smaller diameter than the tube, and has been twisted, for example against its coiling direction, during assembly so as to give its turns a larger diameter. After the wire has been applied around the tube, the twisting force is released and the wire will surround the tube with clamping fit.

In spite of the comparatively great pitch which the wire may have, for example several mm, for example 4 or 9 mm, the wire provides a good electrical screening of the current conductor which runs alongside the discharge vessel and also on that account counteracts the disappearance of sodium, if this should be present in the discharge vessel. The construction provides a reliable protection against damage to the outer bulb in the case of an exploding discharge vessel The influence on the luminous flux of the lamp is very slight.

BRIEF DESCRIPTION OF THE DRAWING

An embodiment of the electric lamp according to the invention is shown in side elevation in the drawing.

DESCRIPTION OF THE PREFERRED EMBODIMENTS

In the FIGURE, the electric discharge lamp has an outer bulb, or envelope 1 which is closed in a gaslight manner and which accommodates a light source capsule in the form of a discharge vessel 2 which is closed in a gastight manner and which has an axis 3 and seals 4 on its axis. A glass tube, or sleeve, 10, for example, made of quartz glass or of hardglass, axially surrounds the discharge vessel. The tube has a surrounding part 11. A pair of electrodes 6 is present in the discharge vessel in an ionizable medium. Current conductors 7 extend from outside the outer bulb to the pair of electrodes and are connected thereto. The conductors connect the light source capsule 2 to a source of electric potential to energize it to emit light. The glass tube 10 is fastened to a current conductor 7 by means of clamping strips 5. The tube may have a wall thickness of, for example, 1 mm or less.

A helically coiled metal wire 11 surrounds the glass tube 10 and is fixed around said tube so as to be electrically floating.

To achieve this, for example, resistance wire may be used, for example, kanthal wire or tantalum wire. In the lamp shown, wire of 0.25 mm diameter is used, coiled with a pitch of 5 mm. Alternatively, however, a thinner wire, for example of 0.2 mm, or a greater pitch may be used, for example 7 min. The coiled wire is thin and has an open structure. Influence on the luminous flux of the lamp, therefore, is scarcely perceivable.

The wire 11 is fixed around the tube 10 by its own clamping force.

The lamp shown in a high-pressure metal halide discharge lamp which contains metal halides, mercury, and rare gas. The lamp consumes a power of 70 W during operation.

During stable lamp operation, the discharge vessel was made to explode by means of a current surge. The outer bulb remained entirely undamaged during this, which proves that the construction of the lamp effectively protects the surroundings against the consequences of an explosion of the discharge vessel.

The wire surrounding the tube is electrically floating. Disappearance of sodium, if present, from the discharge vessel is effectively counteracted by this. If an electron should be detached from the wire by UV radiation, the wire is given a positive potential which slows down further electron losses. Moreover, the wire effectively screens the current conductor extending alongside the discharge vessel from the discharge.

It was found that the construction is sufficiently effective and reliable when the wire surrounds the pair of electrodes, i.e. the cavity of the discharge vessel, laterally.

I claim:

1. An electric discharge lamp, comprising:

an outer bulb closed in a gastight manner;

a discharge vessel closed in a gastight manner and having an axis and seals on its axis, a pair of electrodes being arranged in said discharge vessel;

a glass tube axially surrounding the discharge vessel;

current conductors which extend from outside the outer bulb to the pair of electrodes and are connected thereto; and a helically coiled metal wire surrounding the glass tube and fixed around said tube so as to be electrically floating, said helically coiled metal wire having a plurality of turns extending in the axial direction of said discharge vessel, said helically coiled metal wire defining a single helix and said coil turns not crossing each other.

2. An electric lamp as claimed in claim 1, characterized in that the metal wire is fastened to the tube.

3. An electric lamp as claimed in claim 1, characterized in that the metal wire is fixed around the tube by its own clamping force.

4. An electric lamp according to claim 3, wherein said metal wire has a diameter of between about 0.2 mm and about 0.25 mm and a pitch of between about 5 mm and about 7 mm.

5. An electric lamp according to claim 1, wherein said metal wire has a diameter of between about 0.2 mm and about 0.25 mm and a pitch of between about 5 mm and about 7 mm.

6. An electric lamp, comprising:

an outer lamp envelope;

a light source capsule disposed within said outer lamp envelope and energizeable for emitting light;

means for connecting said light source capsule to a source of electric potential outside of said outer lamp envelope; and containment means for containing said light source capsule within said outer lamp envelope in the event of explosive rupture of said light source capsule, said containment means consisting of a light transmissive sleeve having a length dimension and surrounding said light source capsule and a single length of helically coiled wire fixed on said sleeve and having a plurality of coil turns extending along the length dimension of said sleeve, said helically coiled wire defining a single helix and said coil turns not crossing each other.

7. An electric lamp according to claim 6, wherein said metal wire is electrically floating.

8. An electric lamp according to claim 6, wherein said metal wire is fixed around said sleeve by its own clamping force.

9. An electric lamp according to claim 8, wherein said metal wire has a diameter of between about 0.2 mm and about 0.25 mm and a pitch of between about 5 mm and about 7 mm.

10. An electric lamp according to claim 6, wherein said metal wire has a diameter of between about 0.2 mm and about 0.25 mm and a pitch of between about 5 mm and about 7 mm.

* * * * *